United States Patent [19]
Engel

[11] Patent Number: 4,487,417
[45] Date of Patent: Dec. 11, 1984

[54] PUZZLE AMUSEMENT DEVICE

[76] Inventor: Douglas A. Engel, 2935 W. Chenango, Englewood, Colo. 80110

[21] Appl. No.: 425,224

[22] Filed: Sep. 28, 1982

[51] Int. Cl.[3] ..... A63F 7/04
[52] U.S. Cl. ..... 273/115; 273/280; 273/271
[58] Field of Search ..... 273/113, 115, 116, 153 S, 273/153 R, 280

[56] References Cited

U.S. PATENT DOCUMENTS

| | | | |
|---|---|---|---|
| 112,823 | 3/1871 | Loyd | 273/153 R |
| 509,362 | 11/1893 | Casler | 273/115 |
| 615,413 | 12/1898 | Sharpe | 273/113 |
| 627,127 | 6/1899 | Mayhew | 273/153 R |
| 669,452 | 3/1901 | Ashby et al. | 273/113 |
| 2,011,266 | 8/1935 | Boynton | 273/153 R X |
| 3,610,628 | 10/1971 | Promin | 273/138 R |
| 4,376,537 | 3/1983 | Yokoi | 273/153 S |
| 4,395,041 | 7/1983 | Goldfarb et al. | 273/119 A |

FOREIGN PATENT DOCUMENTS 2434523 8/1975 Fed. Rep. of Germany ..... 273/115

*Primary Examiner*—Richard C. Pinkham
*Assistant Examiner*—Scott Brown
*Attorney, Agent, or Firm*—Crandell & Polumbus

[57] ABSTRACT

An amusement device for selectively interchanging or transferring coded pieces from one storage element to a second adjacent storage element is disclosed. The two storage elements are connected to each other for relative rotation. The coded pieces are transferred by aligning one or more storage space or cavity containing a coded piece, in one storage element with like storage spaces or cavities in the adjacent storage element and inverting the device. The storage cavities are configured to allow a prearranged relationship between coded pieces upon rotational alignment of storage cavities lying on the same radius from the axis of rotation. Self-contained games and multiple puzzle configurations are achievable by sequential rotation, alignment and inversion of storage cavities.

2 Claims, 13 Drawing Figures

PUZZLE AMUSEMENT DEVICE

BACKGROUND OF THE INVENTION

1. Field of the Invention

The present invention relates generally to puzzles and amusement devices. More specifically, the present invention relates to a puzzle or amusement device incorporating shiftable or transferable pieces therein.

2. Brief Description of the Prior Art

Shiftable or transferable pieces are the basis of many previously well known puzzles and board games. Some games, like chess and checkers, which utilize separate but movable pieces, go back to ancient times. Still other games, like tic-tac-toe, utilize a prearranged coded grid, as does checkers and chess, which more often than not is a piece of paper marked on with a pencil. The transferable elements are marked directly on the paper in pencil. Games of the foregoing type, wherein separate pieces or indicia are used on a preestablished and standardized grid area, are not known or available in a self-contained amusement device.

A self-contained amusement device offers many advantages. It is going to be generally smaller and therefore more easily carried. The self-contained pieces cannot be lost. A self-contained game is readily adapted to taking along on extended trips. The relative bulk and relatively large number of pieces make traveling with a chess or checkers set both cumbersome and risky, due to the possibility of loss of some of the separate pieces.

Other amusement devices relate strictly to puzzles which are to be mixed up into an unsolved configuration and then elements or indicia of the puzzle are rearranged into a solved configuration. It is well known to store the elements in a common base or other structure. For instance, Rubik's Cube utilizes a pair of intersecting axles to permit rotation thereabout by groups of cube-shaped elements or indicia. In Rubik's Cube, the indicia are color-coded and the object is to manipulate the separate elements into a solved configuration wherein each surface of the cube is a specific color.

Another such self-contained puzzle is The Fifteen Puzzle of Sam Lloyd. The Sam Lloyd puzzle involves two-dimensional movement of square pieces within a base portion. A single area of the base portion is vacant to allow sequential movement of individual squares into the area, which area changes with the movement of each such square. The puzzle, in fact, has no solution for the reason that it is assembled in an unsolved position and can never be manipulated into a solved configuration.

Applicant's copending application, U.S. patent application Ser. No. 304,092, now U.S. Pat. No. 4,415,158, also involves a self-contained puzzle that is color-coded in a solved position. Intersecting geometric figures having elements movable from one geometric figure to the other geometric figure by rotation of the geometric figures about their respective axes is shown.

So far as applicant is aware, the movement of coded pieces within a self-contained puzzle has, at all times heretofore, been based upon movement of the pieces within a single plane by rotational or translational movement within that plane. No one has combined such movement with a separate movement in a third dimension out of the plane of rotational or translational movement. This additional movement allows simulation of games using movable separate pieces, such as is required in chess, checkers or tic-tac-toe. Furthermore, as a puzzle, additional complexity and eye-hand movements are introduced that would make the puzzle more interesting, as well as a greater challenge.

The ability to permit transferal of pieces across a plane or interface, wherein translational and rotational movement of the elements occurs, has not heretofore been known. It has therefore not heretofore been known to selectively pass these pieces so as to control subsequent transfers of other pieces. Such a physical or mechanical transference is analogous to and can be used to represent certain functions of Boolean logic, which is the foundation for basic computer circuits. Such devices as "OR" and "AND" gates can be simulated in a puzzle configuration or even incorporated into teachings situations.

OBJECTS AND SUMMARY OF THE INVENTION

It is the principal object of the present invention to provide a puzzle that moves coded pieces by rotational movements within a plane as well as movements outside the plane.

It is a related object of the present invention to provide an amusement device capable of simulating any number of games.

It is a further related object of the present invention to provide an amusement device that can simulate other games in a self-contained device wherein separate pieces of a game cannot be lost.

It is a still further object of the present invention to provide an amusement device that is capable of simulating certain Boolean logic concepts.

In accordance with the objects of the present invention, an amusement device moves coded pieces within rotational planes, each associated with a separate storage element. The storage elements are rotatable with respect to each other. Coded pieces are stored in cavities formed in one or the other of the storage elements. After alignment of storage cavities between elements, inversion of the device permits simple gravitational forces to transfer a coded piece to an unoccupied storage cavity of a relatively lower storage element from an upper storage cavity of the other or upper storage element.

Rotation of the separate storage elements about an axis of rotation provides for rotational movement of the coded pieces within the plane of their respective element. Transferal across an intermediate plane or interface of surfaces between the two elements can only occur upon alignment of two storage cavities and the absence of a coded piece in the storage cavity to which transfer is desired. Transferal of the coded pieces from one element to the lower element will be precluded by the absence of aligned storage cavities or the prior presence of a coded piece in the element to which transfer is desired.

One of the elements has the storage cavities oriented in a coded array. This coded element selectively receives coded pieces from the adjacent transfer element across the interface between the elements. The adjacent transfer element loses the coded pieces stored within storage cavities of the transfer element to storage cavity positions in the coded element in a predetermined coded manner so as to either simulate a game or to create a coded pattern within the coded element.

Alternative shapes for the storage cavities of the transfer element and coded element are provided. Discrete transfer of single coded pieces across the interface, transfer of multiple coded pieces across the interface, or selective transfer of one or more coded pieces across the interface are possible permutations.

The entire amusement device can be disassembled and coded pieces alternated or moved about to change the complexity and design of the puzzle. In a similar manner, the storage cavities can be switched to different configurations, depending upon the complexity of the puzzle or type of game desired.

DESCRIPTION OF THE PREFERRED EMBODIMENTS

Figure 1:
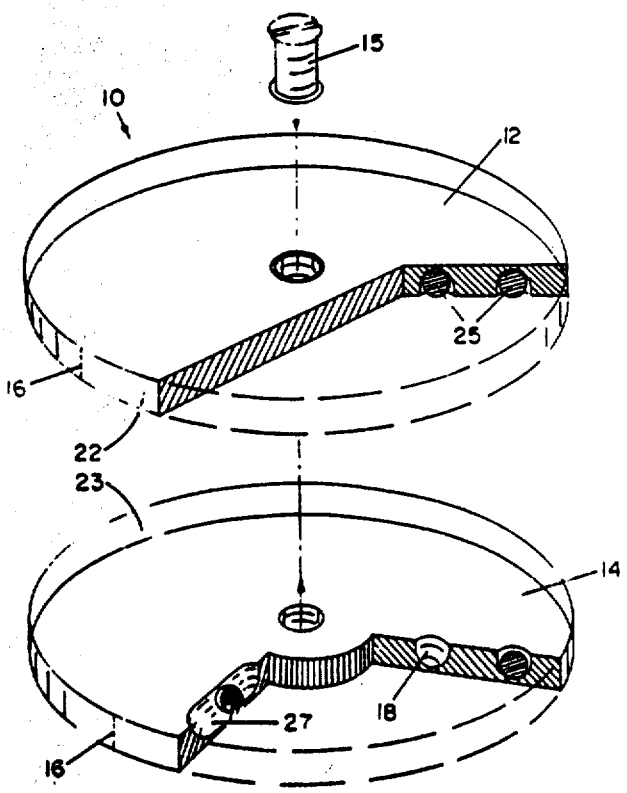
FIG. 1 is an exploded perspective view of one embodiment of the amusement device of the present invention.

The basic structural elements of an amusement device formed in accordance with the present invention are seen in FIG. 1 to include relatively rotatable storage elements 12 and 14 having storage cavities 18 adapted to removably receive coded pieces 25. From the basic structure as seen in FIG. 1, a myriad of variations of games and simulated puzzles, as seen in FIGS. 2 through 7 and 9 through 13, can be derived. Each of the FIGS. 2 through 7 show an alternative way in which the amusement device can be configured to simulate a game or establish a new and unusual puzzle.

Most of the embodiments described in the specification and shown in the drawings are exemplified by the first embodiment 10 of the amusement device seen in FIG. 1. The amusement device 10, as mentioned previously, includes a transfer storage element or disc 12 and a coded storage element or disc 14 rotatably connected together by a pin 15 passing through the centers of the respective elements 12 and 14. Each of the elements 12 and 14 is of disc-shaped configuration having a circular plan view and a constant height dimension 16 sufficient to allow the formation of a number of dome-shaped storage cavities 18 in one surface of the elements 12 and 14.

When the transfer element 12 is pivotally connected to the coded element 14 by the pin 15, the elements 12 and 14 are rotatable with respect to each other between surface 22 of the transfer element 12 and surface 23 of the coded storage element 14 defining an interface therebetween. The storage cavities 18 are seen to be formed in the surface 22 and 23.

Coded pieces 25, which are preferably balls or spheres of different colors, are placed within the storage cavities 18 prior to connection of the transfer element 12 to the coded element 14. The coded pieces 25 can be rotated about the pin 15 in either of the elements 12 or 14 and can be gravitationally transferred from the transfer element 12 to the coded element 14 or from the coded element 14 to the transfer element 12 by aligning a storage cavity 18 containing a coded piece 25 and empty storage cavity 18 formed respectively in surfaces 22 and 23, and inverting the entire amusement device 10.

The amusement device is usable in two basic ways. The coded element 14 has a preset orientation of storage cavities 1 formed in the surface 23 thereof. The coded pieces 25 are moved from one storage cavity 18 in the surface 23 to another by rotational alignment of like storage cavities 18 in the surface 22 and inversion of the amusement device transfers the coded piece 25 across the interface between surfaces 22 and 23 to the transfer element 12 and a second relative rotation of the elements 12 and 14 aligns the coded piece with a different storage cavity 18 associated with the surface 23. Reinversion of the amusement device 10 results in the coded piece being moved to a new storage cavity 18 within the coded element 14.

The self-enclosed amusement device, wherein the coded pieces 25 represent pieces of a previously known game, can simulate well known games. Alternatively, any number of geometric and color-coded orientations for the storage cavities 18 in the surface 23 of the coded element 14 are possible. A set pattern of storage cavities 18 in the surface 22 of the transfer element 12 can be utilized to transfer coded pieces 25 to positions in the coded element 14, defining a puzzle. Both of these uses of the amusement device 10 will now be discussed in detail.

In a second embodiment 10', like parts are given like numbers with prime suffixes. In the second embodiment of the amusement device of the present invention (FIG. 2), the orientation of the storage cavities 18' of the coded element 14' can be set to correspond to many known games. The coded pieces 25' can be stored in enlarged storage cavities 27 formed in the surface 23 of the coded element 14' and transferred by the transfer element 12' to a position in the orientation of the storage cavities 18' corresponding to, for instance, a chess, checkers or tic-tac-toe move.

Figure 2:
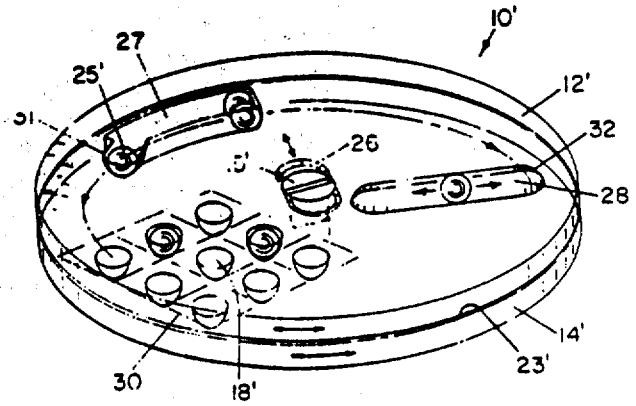
FIG. 2 is a perspective view of a second embodiment of the amusement device of the present invention, with certain portions broken away and shown as sections for clarity.

In FIG. 2, the embodiment of the amusement device 10' is shown wherein the game of tic-tac-toe can be played. The transfer element 12', which in the drawing and normal use of the amusement device is normally the top or upper element, includes an elongated slot 29 formed therein extending around the pin 15'. The elongated slot 26 permits movement of the transfer element 12' relative to the coded element 14' so that it is easier to transfer the coded pieces 25' to preselected storage cavities 18' in the coded element 14'. The transfer element 12' also includes a radially extending transfer slot 28, which transfer slot 28 extends over a field 30 of storage cavities 18' which are aligned in the three-by three arrangement associated with tic-tac-toe in the coded element 14'.

The coded element 14' also has formed in the surface 23' thereof the storage slot 27 in which multiple coded pieces 25' of two different colors, one for each player, are stored. The storage slot 27 has a single access port 31 that is located at one end of the storage slot 27. The access port 31 registers with a terminal end 32 of the transfer slot 28 to a sufficient degree to allow one of the balls or coded pieces 25' to move across the interface from the storage slot 27 into the transfer slot 28 upon inversion of the amusement device 10'.

Once one or more of the coded pieces 25' are within the transfer slot 28, the transfer slot is oriented over the desired storage cavity 18' in the field 30 and the coded piece 25' is permitted to drop into the selected storage cavity 18'. By skewing the transfer element 12' along the connection slot 26 and relative to the coded element 14', the transfer slot 28 can be made to register with one and only one storage cavity 18'. Successive turns by each player will complete the tic-tac-toe game.

Larger, more complex fields 30 associated with checkers and chess can be accommodated. In the case of those games, the transfer slot 28 must be used to move coded pieces 25' within the field 30. From the foregoing, it is clear that the transfer slot 28 can be aligned with a single storage element 18', the coded piece transferred into the transfer slot 28 by inversion of the amusement device, and the transfer slot realigned with a different storage cavity 18' in the field 30 to deposit the coded piece 25' into the new storage cavity 18'. Removal of coded pieces from the field 30 can be accomplished in the same manner.

Figure 3:
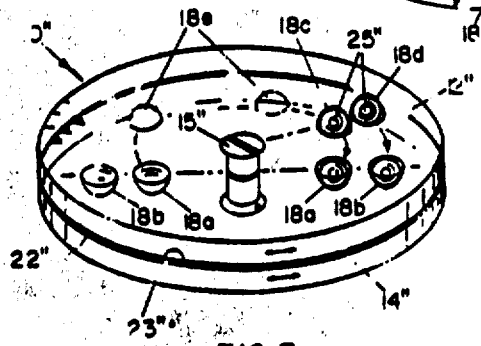
FIG. 3 is a perspective view of a third embodiment of the present invention.

In a third embodiment 10", like parts are given like numbers with a double prime suffix. The present invention is ideally suited for movement of coded pieces 25" into a solved configuration defined by storage cavities 18" in the coded storage element 12". The simplest example of such a puzzle utilizing the amusement device of the present invention is seen in FIG. 3. The main component parts are again the same, the pin 15" rotatably connecting the transfer element 12" to the coded element 14" for relative rotation between the two elements 12" and 14" with respect each other. The preset orientation of the storage cavities is seen in FIG. 3 to be two radially aligned pairs of storage cavities formed in the surface 23" of the coded element 14". Storage cavities 18a of the coded element 14" are seen to be aligned along equal length radii, as are storage cavities 18b. Storage cavities 18c and 18d are formed in the surface 22" of the transfer storage element 12. The storage cavity 18c is on a radii of equal length to the radii upon which storage cavities 18a are formed and storage cavity 18d is on a radii equal to the radii of storage cavities 18b. It is therefore seen that rotation of the transfer element 12" to a position where storage cavities 18c and 18d are aligned with either pair of storage cavities 18a and 18b will allow passage of coded pieces 25" from storage cavities 18c and 18d to storage cavities 18a and 18b, if cavities 18a and 18b are empty. If storage cavities 18a and 18b are not empty, but are filled with coded pieces 25", then the storage cavities 18c and 18d will deposit their coded pieces in the other storage cavities 18a and 18b. If storage cavities 18c and 18d have no coded pieces 25", they can receive coded pieces from a pair of storage cavities 18a and 18b by inversion of the amusement device 10".

As seen in FIG. 3, the storage cavities 18e, shown in phantom lines, could be formed on different nonaligned equal length radii so that only one coded piece 25" would pass with each inversion of the amusement device 10.

In general, each radius on which a coded piece 25" is maintained in a corresponding storage cavity 18", will have at least one associated storage cavity on the other element 12" or 14" to allow transfer of the coded piece 25". Increasing the number of storage cavities 18" on any given radius increases the complexity of the puzzle by allowing for transferal of multiple coded pieces 25" to many different storage cavities 18", with the effect of scrambling the puzzle from a desired solved configuration. There should be more than, one storage cavity, i.e., 18e, of the transfer element 12" associated with each corresponding storage cavity on the other of the elements 12" or 14". It is also noted that a substitution of different coded pieces will alter the nature of the puzzle.

Those familiar in the art will have no trouble arriving at numerous puzzle configurations dependent upon the nature of the coded pieces, the orientation of the storage cavities and the transfer element surface and the orientation of the storage cavities 18" and the coded, element surface 22".

In a similar manner to what was discussed in reference to FIG. 2, the coded elements 25" of FIG. 3 are passed by rotational movement of the elements 12" and 14" relative to each other until alignment between one or more storage cavities in the respective surfaces 22" and 23" is achieved. The amusement device 10" is inverted and the coded pieces 25" are passed from one element to the other. While in the inverted position, the storage elements 12" and 14" are rotated again to a new alignment position between storage cavities. Subsequent reinversion of the amusement device 10" results in a transfer of the coded pieces 25" from one storage cavity of the coded element 14" to another storage cavity of the coded element 14".

Figure 4:
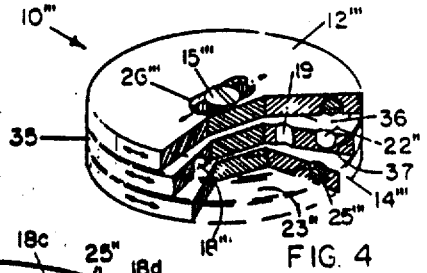
FIG. 4 is a perspective view of a fourth embodiment of the present invention, with certain portions broken away and shown as sections for clarity.

In a fourth embodiment 10"' seen in FIG. 4, like parts are given like numbers with a triple prime suffix. FIG. 4 shows a three-element configuration of the amusement device 10"' including an intermediate sandwiched element 35. The transfer element 12"' includes the connection slot 26"' as previously described in reference to FIG. 2. This allows linear movement of the transfer element 12"' relative to the remaining elements 35 and 14"' to achieve different alignments between storage cavities 18"'.

The intermediate sandwiched storage element 35 is connected by the pin 15"' intermediate the transfer element 12"' and the coded element 14"'. The intermediate storage element includes two surfaces, 36 adjacent to surface 22"' and 37 adjacent to surface 23"', in which surfaces 36 and 37 storage cavities 18"' can be formed. It is seen that where only storage cavities 18"' are formed in the intermediate element 35, there are two different solved configurations, one corresponding, as before, to the storage cavities in the surface 23"' of the coded element, and another corresponding to the storage cavities in the surface 36 of the intermediate element 35. Again, depending on the number of storage cavities 18'''', the complexity of the puzzle is greatly increased.

Alternatively, the embodiment of FIG. 4 includes bores 19 formed completely therethrough which allow passage of coded pieces 25''' from storage cavities 18''' in the transfer storage element 12''' to storage cavities 18''' in the coded element 14'''.

Figure 5:
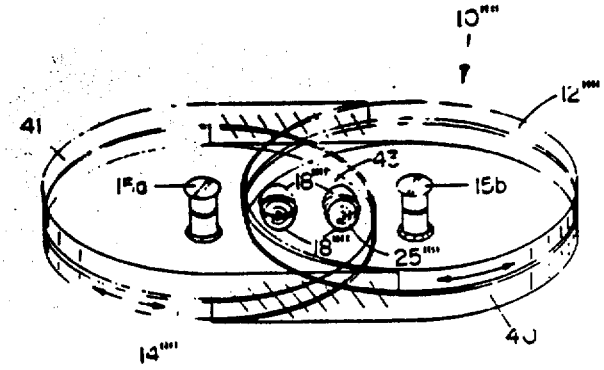
FIG. 5 is a perspective view of a fifth embodiment of the present invention.

In a fifth embodiment 10'''' in FIG. 5, like parts are given like numbers with a quadruple prime suffix. FIG. 5 shows an embodiment 10'''' wherein two pins 15*a* and 15*b* interconnect the transfer element 12'''' to the coded element 14'''' on parallel axes. In order to make an integral unit, the amusement device 10'''' includes a lower fixed base support 40 through which pin 15*b* pivotally connects the transfer element 12'''', and an upper rotatable base support 41 to which the coded element 14'''' is pivotally connected by the pin 15*a*. An intermediate plane is defined for an area of intersection 43 between the adjacent, but not totally superimposed, elements 12'''' and 14''''. The base supports 40 and 41 maintain the coded pieces 25'''' within their corresponding storage cavities 10'''' in all inversions of the amusement device 10'''' except those occurring in the area of intersection 43. In the intersection area 43, transfer of the coded pieces 25'''' occurs, as before, upon alignment of storage cavities 18'''' of the transfer element 12'''' with storage cavities 18'''' of the coded element 14''''. As has been the case in all previous embodiments, the elements 12'''' and 14'''' and the supports 40 and 41 are all formed of clear plastic so that the coded pieces 25'''' can be seen regardless of the positioning of the element 12'''' and coded element 14'''' relative to each other.

Additional complexity can be obtained by forming storage cavities 18 (not shown) in the supports 40 and 41 so that inversion of the amusement device 10'''', in areas outside the area of intersection 43 does not necessarily mean that a transfer of pieces 25'''' will not occur.

Figure 6:
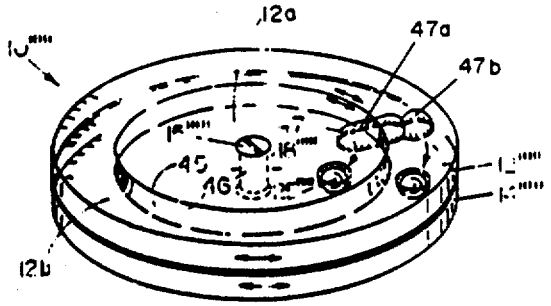
FIG. 6 is a perspective view of a sixth embodiment of the present invention.

In a sixth embodiment 10''''' seen in FIG. 6, like parts are given like numbers with a quintuple prime suffix. The amusement device of the present invention seen in FIG. 6 includes a bifurcated transfer element 12''''' consisting of an inner disc 12*a* having a concave peripheral surface 45 and an outer ring 12*b* having an inner convex peripheral surface 46 in facing and sliding contact with the surface 45. The elements 12*a* and 12*b* are thus kept in contact with each other and are subject to relative rotation about a connection pin 15'''''. The connection pin 15''''', in a manner as previously described, connects the inner element 12*a* to the coded element 14'''''. A cavity portion 47*a* is associated with the element 12*a*, and a second portion 47*b* is associated with the element 12*b*. Relative rotation between the elements 12*a* and 12*b* can align portions 47*a* and 47*b* to allow transfer of a coded pieces 25 from element 12*a* to element 12*b* upon tilting of the amusement device 10''''' from the position seen in FIG. 6.

As with previous embodiments, storage cavities 18''''' in the coded element 14''''' are selectively aligned with the portions 47*a* and 47*b*, to allow for multiple modes of transference of coded pieces between the three storage elements 12*a*, 12*b* and 14'''''.

Figure 7:
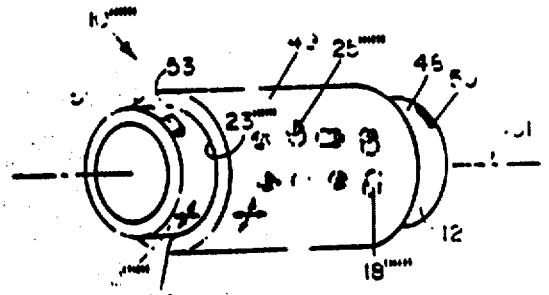
FIG. 7 is a perspective view of a seventh embodiment of the present invention.

In a seventh embodiment seen in FIG. 7, like parts are given like numbers with a sextuple prime suffix. FIG. 7 discloses an additional embodiment 10'''''' of the amusement device of the present invention wherein the interface between a cylindrical element 48 and hollow cylindrical element 49 is a cylindrical plane about and along which plane the element 48 is rotatable and slideable along. Stops 50 prevent removal of the element 48 from the element 49. As is the case in most previous embodiments, both elements 48 and 49 are rotatable about a common coaxial or parallel axes 51. In a similar manner to what was previously done in other embodiments, the storage cavities 18'''''' are formed in surfaces 22'''''' and 23'''''' respectively. Extra complexity of the puzzle of the amusement device 10'''''' of FIG. 7 is created by reason of the fact that transfer of the coded pieces 25'''''', will occur from the element 49 to the transfer element 48 at the same time as coded pieces 25'''''' are transferring from the transfer element 48 to the coded element 49, this by reason of the fact that the intermediate plane is rolled back on itself and that the force of gravity moves the coded pieces 25'''''' across the plane at a top 53 and a bottom 54 of the amusement device 10'''''', as it is seen in FIG. 7.

The above described figures represent various embodiments of the amusement device 10. From the foregoing description, it is apparent that there are other permutations of the element 12 and the coded element 14 that might be utilized. As has been previously discussed, the predetermined orientation of the storage cavities 18 within the coded element 14 can be widely varied, together with the color and/or other coding of the coded pieces 25 and the pattern of the storage cavities 18 of the transfer element 12 to achieve many different puzzle configurations.

Figure 8:
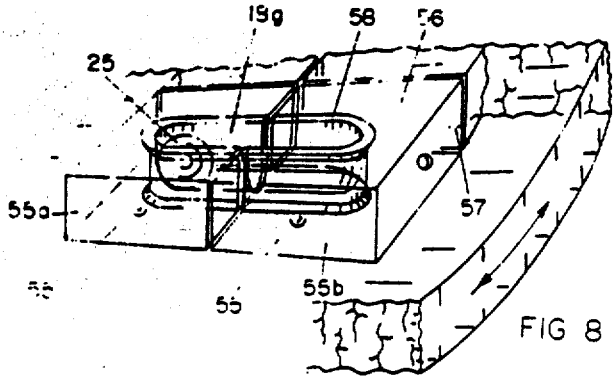
FIG. 8 is a fragmentary perspective view of an amusement device in accordance with the present invention showing an exchangeable storage cavity, with certain portions being shown in section.

In FIG. 8, a removable or changeable cavity body 55 is seen to further enhance the adaptability of the amusement device. The removable cavity 55 includes one or more storage cavities 18 formed in an outer surface 56 thereof for receipt of coded pieces 25. As seen in FIG. 8, an elongated trough or slot 58 of dome-shaped cross section defines the storage cavity 18*g* formed within a two-piece changeable cavity, 55*a* and 55*b* (FIG. 8). The trough 58 is press fit into the cavity 55, providing for different cavity configurations, i.e., shorter, longer or multiple. The cavity 55 is insertable within a recess 57 in one of the surfaces 22 or 23 of one of the storage elements. Suitable connection and release means, such as a simple press fit, are utilized to secure the cavity 55 within the recess 57.

As can the configurations associated with the storage elements, the cavities can take on numerous configuration, other than the elongated and generally hemispherical or dome-shaped cavity trough 58 previously exclusively discussed. In FIGS. 9 through 13, various alternative configurations are depicted that alter the manner in which coded pieces 25 are transferred between elements.

Figure 9:
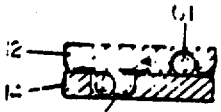
FIG. 9 is a fragmentary section showing an upper and lower storage cavity of an amusement device in accordance with the present invention.
Figure 10:
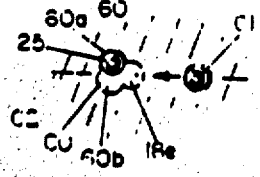
FIG. 10 is a diagrammatic operational view of the pair of aligned storage cavities of FIG. 9.

In FIGS. 9 and 10, a discrete cavity 60 of three overlapping dome-shaped cavities 18 is shown, formed in one of the elements. As best seen in FIG. 10, the arrow indicating movement of an upper element over a lower element of the amusement device containing the cavity 60, the presence of a single coded piece 25 in the overlapping cavity 60 will prevent transferal of the coded piece 61 into the storage cavity 18*e*. Either storage cavity forming a portion 60*a* or 60*b* of the overlapping storage cavity 60, containing a coded piece 25 will prevent the transferal of the coded piece 61. Instead of the triple cavity 60 seen in FIG. 10, a double cavity oriented along line 62 would give a similar result if one of the cavities is occupied by one of the coded pieces 25.

The cavity configuration seen in FIGS. 9 and 10 is particularly adaptable for use in illustrating Boolean logic principles surrounding the logical "OR". The presence of one coded piece 25 prevents insertion of an additional coded piece 61.

Figure 11:
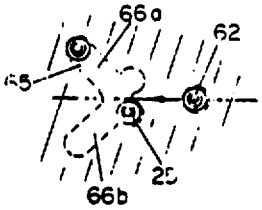
FIG. 11 is a diagrammatic operational view of another pair of aligned storage cavities of the present invention.

FIG. 11 shows a cavity configuration 65 similar to cavity configuration 60, including a pair crossing elongated slot portions 66a and 66b. The presence of the coded piece 25, as illustrated, allows a coded piece 62 to drop into the slot portion 66a, but not in slot portion 66b. This illustrates the logical "If A but not B, then C".

Figure 12:
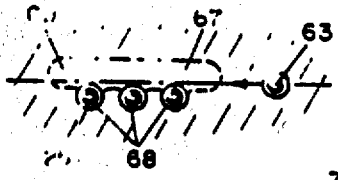
FIG. 12 is a diagrammatical operational view of still another pair of aligned storage cavities of the present invention.

A storage cavity 67 seen in FIG. 12 includes three side cavities 68 dispersed laterally away from an elongated slot 69. All three cavities 68 must be filled by coded pieces 25 to prevent a coded piece 63 from entering the storage cavity 67. This mechanical function of the amusement device illustrates the logical "If A and B and C, then not D".

Figure 13:
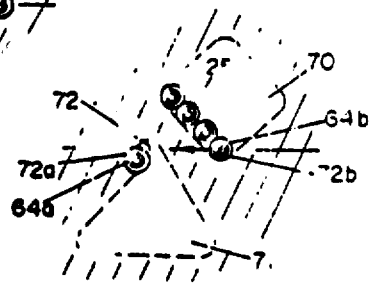
FIG. 13 is a fragmentary section plan view of still another pair of aligned storage cavities of the present invention.

FIG. 13 shows two enlarged geometrically-shaped storage cavities 70 and 71 moving over each other having a common area 72a and 72b in which, once the areas 72a and 72b are aligned, transferal of coded pieces 25 can take place, the presence of a coded piece 64a and 64b, as seen in FIG. 13, in both the areas 72a and 72b prevents any transferal of the coded pieces. This illustrates logically "If A, then none of B, or if not A, then all of B".

With reference to FIGS. 9 through 13, it will be realized that the positions of the coded pieces shown illustrate but one possible outcome of the logical statement given. A complete truth table for each statement could be analogized by removing or adding coded pieces from the positions shown.

Utilizing the cavity body 55 and trough 58 of FIG. 8, different cavity configurations as seen in FIGS. 9 through 13 can be incorporated to alter the results of a given puzzle of the amusement device.

Rather than using gravity and the necessity of inverting the amusement device 10, transfer of coded pieces 25 could be accomplished by magnets located in the storage elements 12 and 14. A shake of the amusement device or switching off of electromagnets would transfer them.

Although the present invention has been described with a certain degree of particularity, it is understood that the disclosure made herein is made by way of example and that departures from the structure of the invention as described in the foregoing description may be made without departing from the spirit of the invention as more particularly defined in the appended claims.

What is claimed is:

1. An amusement device comprising in combination:

a pair of storage elements rotatable relative to each other in face-to-face relationship, each storage element having at least one hemispherically-shaped hole defining a storage cavity, which storage cavities are in overlapping alignment between the storage elements; and means for transferring a plurality of pieces between storage cavities of one of said storage elements to storage cavities of the other of said storage elements by selective rotation of said storage elements to align said overlapping storage cavities permitting transferral of said pieces from one to the other of said storage cavities, the receipt of any one spherical piece precluding the transfer of any additional spherical pieces.

2. The invention defined in claim 1 wherein said storage cavities are formed in cavity elements, which cavity elements are removable from said storage elements for replacement with alternative storage cavity elements.

• • • • •